US007121784B2

(12) United States Patent
Pinto

(10) Patent No.: US 7,121,784 B2
(45) Date of Patent: Oct. 17, 2006

(54) OPERATIVE ARM EXCAVATOR INCLUDING LINKAGE GENERALLY INTERPOSED BETWEEN BUCKET AND HYDRAULIC ACTUATOR

(75) Inventor: Massimo Pinto, Turin (IT)

(73) Assignee: CNH America LLC, New Holland, PA (US)

( * ) Notice: Subject to any disclaimer, the term of this patent is extended or adjusted under 35 U.S.C. 154(b) by 21 days.

(21) Appl. No.: 11/055,804

(22) Filed: Feb. 11, 2005

(65) Prior Publication Data

US 2005/0186061 A1 Aug. 25, 2005

(30) Foreign Application Priority Data

Feb. 19, 2004 (IT) ..... TO2004A0094

(51) Int. Cl.
*E02F 3/30* (2006.01)

(52) U.S. Cl. ..... 414/723; 37/468

(58) Field of Classification Search ..... 414/685, 414/694, 723; 37/468
See application file for complete search history.

(56) References Cited

FOREIGN PATENT DOCUMENTS

RU 2004702 C1 12/1993

*Primary Examiner*—Donald Underwood
(74) *Attorney, Agent, or Firm*—Stephen A. Bucchianeri; John William Stader; Michael G. Harms

(57) ABSTRACT

An operative arm of an earth moving machine includes a dipper stick having a distal end, a bucket coupled to the distal end of the dipper stick, a hydraulic actuator coupled to the dipper stick, and a linkage generally interposed between the bucket and the hydraulic actuator. The linkage includes the following items: (i) a first lever rotatably coupled to the dipper stick and the hydraulic actuator, (ii) a linear actuator rotatably coupled to the dipper stick, (iii) a second lever rotatably coupled to the first lever and the linear actuator, and (iv) a bucket lever interconnecting the second lever, the linear actuator and the bucket.

4 Claims, 2 Drawing Sheets

OPERATIVE ARM EXCAVATOR INCLUDING LINKAGE GENERALLY INTERPOSED BETWEEN BUCKET AND HYDRAULIC ACTUATOR

BACKGROUND OF RELATED ART

The preferred embodiment relates to an operative arm of an earth moving machine, and in particular to an operative arm of an excavator, whereto the following disclosure explicitly refers without thereby losing its general nature.

In general, the operative arm of excavators comprises a terminal arm (commonly known as a "dipper stick") which, at its end, bears a hinged bucket and which is provided with a hydraulic actuator, whose rod is coupled to the bucket via a lever.

As is well known, the bucket can be used both to dig, break up the soil and load and transport material. Operators want high digging or impacting forces on the soil for digging operations, while during loading and transporting operations operators want an opposite need—having a wide angular excursion of the bucket.

Known systems attempting to increase the rotating torque of the bucket (and hence the digging force) include hydraulic systems that provide a momentary increase in pressure during the operation of the actuator that sets the bucket in rotation. However, repeated and frequent pressure peaks entail a high risk of breakage in the hydraulic system of the excavator.

SUMMARY OF THE INVENTION

According to one aspect of the invention, an operative arm of an earth moving machine includes a dipper stick having a distal end, a bucket coupled to the distal end of the dipper stick, a hydraulic actuator coupled to the dipper stick, and a linkage generally interposed between the bucket and the hydraulic actuator. The linkage includes the following items: (i) a first lever rotatably coupled to the dipper stick and the hydraulic actuator, (ii) a linear actuator rotatably coupled to the dipper stick, (iii) a second lever rotatably coupled to the first lever and the linear actuator, and (iv) a bucket lever interconnecting the second lever, the linear actuator and the bucket.

BRIEF DESCRIPTION OF THE INVENTION

Figure 1:
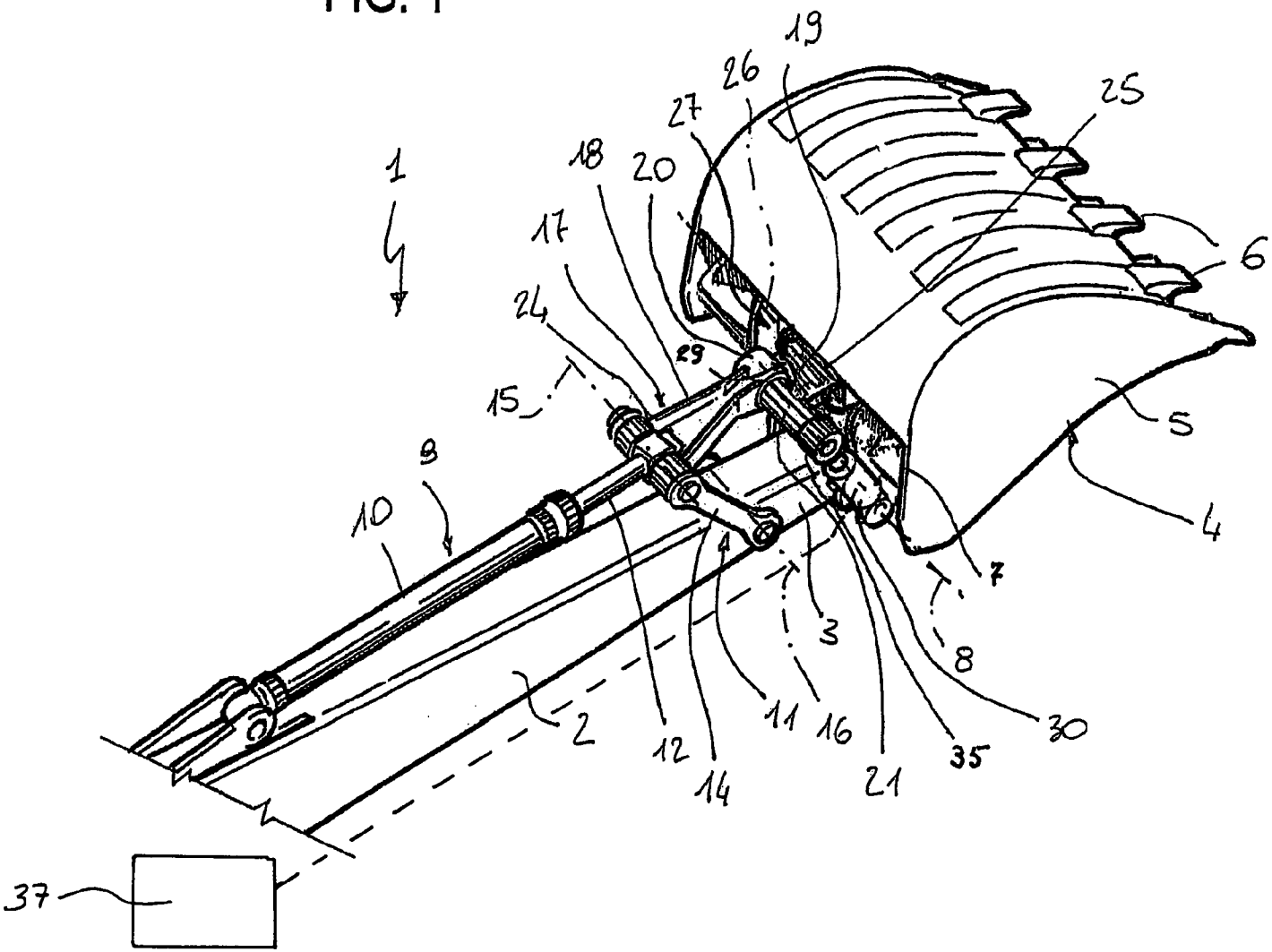
Figure 2:
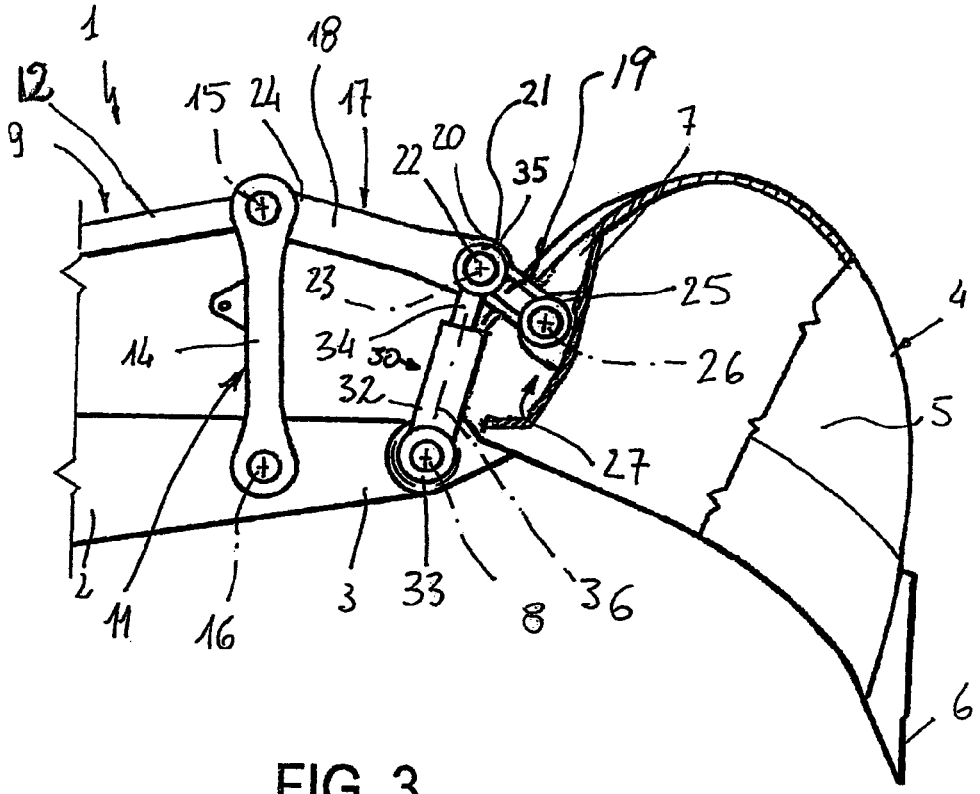
Figure 3:
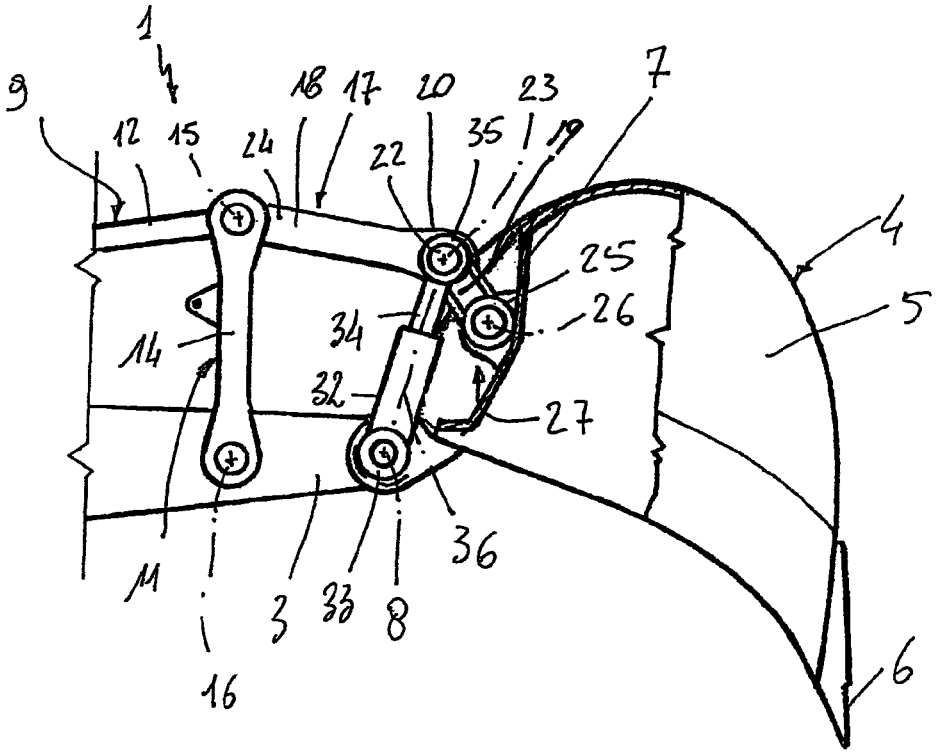

The invention shall now be described with reference to the accompanying drawings, which illustrate a non-limiting embodiment thereof, in which:

FIG. 1 is a partial perspective view of a preferred embodiment of the operative arm of an earth moving machine, in particular of an excavator, according to the preferred embodiment of the invention; and FIGS. 2 and 3 are lateral views, with the bucket in section, which show a detail of FIG. 1 in two different operative conditions.

DETAILED DESCRIPTION OF THE PREFERRED EMBODIMENT

In FIG. 1, the reference number 1 generally designates an operative arm (partially shown) of an earth moving machine, in particular an operative arm of an excavator (not shown). The arm 1 comprises an elongated terminal element 2 (commonly known as a "dipper stick"), having a terminal support portion 3 bearing a bucket 4. The bucket 4 comprises a hollow front portion 5 terminating with a series of digging teeth 6 and a rear portion 7, hinged to the portion 3 about a horizontal axis 8. The bucket 4 is rotatable about the axis 8 under the action of an actuating device 9, which comprises a hydraulic jack or actuator 10 borne by the element 2 and a linkage 11 interposed between the movable stem 12 of the jack 10 and the portion 7.

The linkage 11 defines, together with the portion 3, an articulated quadrilateral and comprises a lever 14, whose ends are hinged to the rod 12 and to the portion 3 about an axis 15 and, respectively, about an axis 16 parallel to the axis 8.

With reference to FIGS. 2 and 3, the linkage 11 further comprises a toggle lever mechanism 17 comprising, in turn, two levers 18, 19, which end with respective bushings 20,21 hinged to each other by means of a pivot pin 22 about an intermediate axis 23 parallel to the axis 8, in such a way as to define the toggle of the lever mechanism 17 itself. At the opposite side, the levers 18,19 end with respective terminal portions 24,25, which are hinged to the stem 12 and, respectively, to the portion 7, about the axis 15 and, respectively, about an axis 26 which is also parallel to the axis 8.

The length of the lever 19, measured in orthogonal direction to the axes 23,26, is smaller than the length of the lever 18, measured in orthogonal direction to the axes 15,23, in such a way as to make the axis 23 relatively close to the axis 26. The bushing 20 is aligned and approached axially to the bushing 21 and extends starting from an end of the pivot pin 22, whilst the portion 25 is housed in a rear cavity 27 defined by the portion 7 and projects axially with respect to the bushing 21 in a position that faces the bushing 20, in such a way as to define a recess 29 (FIG. 1) partially housing the bushing 20 itself.

The linkage 11, in addition to the rod 14 and to the lever mechanism 17, comprises a linear hydraulic actuator 30, which in turn comprises a jacket 32 ending with a bushing 33 hinged about the axis 8, and a stem 34 ending with a bushing 35 hinged about the axis 23 by means of the pivot pin 22, at the opposite end of the bushing 20.

The actuator 30 defines a rod with adjustable length, since it can be remotely controlled via a remote actuator 37 to translate the stem 34 relative to the jacket 32 along a direction 36 orthogonal to the axes 8, 23 between a rear end stop position (FIG. 2) and a forward end stop position (FIG. 3). In this way, it is possible easily to vary the distance between the axes 8, 23, the torque transmitted by the linkage 11 to the bucket 4 about the axis 8 and, hence the digging force in correspondence with the teeth 6. In particular, in the operative condition in which the stem 34 is at the rear, the linkage 11 assures a high angular excursion of the bucket 4 about the axis 8, whilst in the operative position in which the stem 34 is forward, the linkage 11 allows the bucket a greater torque, for example by about 15%, with a consequence reduction in the maximum angular excursion of the bucket 4, for equal force and total travel of the stem 12. In particular, after the operator of the excavator cab has positioned the stem 34 in the desired position relative to the jacket 32, the rod or lever defined by the actuator 30 rotates together with the bucket 4 about the axis 8 during the operation of the jack 10, leaving unaltered the relative position between the axes 8, 23 and the configuration of the articulated quadrilateral of the linkage 11.

From the above, it is readily apparent that it is possible to increase the digging force avoiding the use of hydraulic systems to increase the pressure powering the jack 10.

Alternatively, the configuration of the linkage 11 can be used to mount a jack 10 of lower power and, hence, less bulky than normally used ones.

When the stem 34 is extended, the torque on the bucket 4 and, hence the digging force in correspondence with the teeth 6 are relatively high even when the stem 12 moves in an initial portion of its outgoing travel, since the actuator 30 acts by varying the point of application of the force that is exerted by the linkage 11 on the bucket 4, without changing the distance between the axes 15,16.

Moreover, it is possible easily to control the approach or move away of the axes 8,15 directly from the excavator cab, thanks to the actuator 30, whilst the set of the linkage 11 and of the bucket 4 is relatively compact, thanks to the conformation and to the position of the levers 18,19 and to the conformation of the portion 7.

From the above, lastly, it is readily apparent that the arm described herein can be subject to modifications and variations, without thereby departing from the scope of protection of the present invention.

In particular, between the axes 8 and 23 could be provided a lever whose length is variable by manual, instead of remote, intervention, or a lever comprising a different adjustment actuator from the one illustrated by way of example herein.

Moreover, the bucket could be replaced by another work accessory, for example a grip member.

The invention claimed is:

1. An operative arm of an earth moving machine, the operative arm comprising:

a dipper stick having a distal end;

a bucket coupled to the distal end of the dipper stick;

a hydraulic actuator coupled to the dipper stick; and a linkage generally interposed between the bucket and the hydraulic actuator, the linkage comprising: (i) a first lever rotatably coupled to the dipper stick and the hydraulic actuator, (ii) a linear actuator rotatably coupled to the dipper stick, (iii) a second lever rotatably coupled to the first lever and the linear actuator, and (iv) a bucket lever interconnecting the second lever, the linear actuator and the bucket.

2. The operative arm according to claim 1, wherein the linear actuator is a linear hydraulic actuator.

3. The operative arm according to claim 1, wherein the bucket lever is shorter than the second lever.

4. The operative arm according to claim 1, wherein the linear actuator further comprises a remote actuator.

* * * * *